US005601907A

United States Patent [19]

Matsumoto

[11] Patent Number: 5,601,907

[45] Date of Patent: Feb. 11, 1997

[54] THREE-DIMENSIONALLY CONSTRUCTED NET

[75] Inventor: Koichi Matsumoto, Fukui, Japan

[73] Assignee: Asahi Doken Kabushiki Kaisha, Fukui, Japan

[21] Appl. No.: 278,666

[22] Filed: Jul. 21, 1994

[51] Int. Cl.[6] ..... D03D 3/00

[52] U.S. Cl. ..... 442/1; 428/131; 428/134

[58] Field of Search ..... 428/229, 131, 428/134

[56] References Cited

FOREIGN PATENT DOCUMENTS

| | | |
|---|---|---|
| 64-30388 | 2/1989 | Japan . |
| 3-158522 | 7/1991 | Japan . |
| 3-183820 | 8/1991 | Japan . |

*Primary Examiner*—Christopher Raimund
*Attorney, Agent, or Firm*—Jordan and Hamburg

[57] ABSTRACT

This invention relates to a three-dimensionally constructed net A for use in various applications including a water collecting and discharging net or a protection net in the faces of slopes in created land or residential sites, a plant protection net, such as a spray sowing net and so on, a building protecting net, an agricultural light-shielding net and a medical net. The net may be conveniently formed by knitting or weaving, so that cord portions which define the meshes are made in hollow three-dimensional construction capable of ventilation and water passage. Thereby, despite the fact that the net is a thick, three-dimensional body, the possession of a void content by the cord portions improves the ventilating and water collecting and discharging effects and saves weight, facilitating the handling and installing of the net, so that the net can be easily handled and well suited for the above-mentioned applications.

14 Claims, 10 Drawing Sheets

THREE-DIMENSIONALLY CONSTRUCTED NET

FIELD OF THE INVENTION

The present invention relates to a three-dimensionally constructed net which can be widely and suitably utilized as various nets, such as a water collection and discharge net or a protection net for use in the faces of slopes in created land or residential sites, a plant protection net for spray sowing or the like, a building protection net, an agricultural light-shielding net, and a medical net.

BACKGROUND OF THE INVENTION

Heretofore, relatively thick, water-permeable fiber layers formed of a double knitted fabric made by the double Raschel machine or a non-woven fabric or the like have been embedded to protect the faces of slopes in residential sites, created land, dikes or the like and to impart a water collecting and discharging effect thereto.

However, with such non-woven fabric, double knitted fabric or the like, the load of fill-up earth acts on the entire fiber layer, with the result that the fiber layer is compressed to cause a decrease in the void content thereof; thus, there is a drawback that the water collecting and discharging effect is spoiled. Further, the fill-up earth is divided into two vertically spaced layers, above and below the fiber layer. The upper fill-up earth tends to slide more easily and if planting is made on this upper fill-up earth, there is another drawback that the growth of the roots of the plant is impeded by the fiber layer. Further, with the usual double knitted fabric, the amount of fiber to be used increases, leading to a high cost and making the fiber layer heavier and difficult to handle, degrading the quality of operations, such as embedding and taut spreading of the net.

Further, of the nets used as slope face protecting nets, planting nets, building protecting nets or the like, many have their cord portions, which define the meshes, made of cords or wires which are solid. Further, knitted fabrics of three-dimensional mesh are also available; in this case also, the cord portions which define the meshes are nothing but those which define a simple wall. Therefore, such net is relatively heavy and difficult to handle, and its cord portions cannot be expected to provide ventilating and water collecting and discharging effects.

OBJECTS OF THE INVENTION

The present invention has been accomplished with the above in mind and is intended to provide a three-dimensionally constructed net, wherein the cord portions defining the meshes are made in hollow three-dimensional construction, so that the possession of voids by said cord portions improves the ventilating and water collecting and discharging effects, while achieving weight saving to provide easy handling, said net being suitable for use as a water collection and discharge net, a protection net or the like.

SUMMARY OF THE INVENTION

A three-dimensionally constructed net according to the present invention which solves said problems is characterized in that the cord portions which define the meshes are made in hollow three-dimensional construction capable of ventilation and water permeation (claim 1).

In this three-dimensionally constructed net, since the cord portions defining the meshes are made in hollow three-dimensional construction and despite the fact that the net in its entirety forms a thick three-dimensional structure, the net has a greater surface area than a net whose cord portions are of ordinary three-dimensional construction which is solid, the void content being also high, the hollow shape of said cord portions being utilized to obtain sufficient ventilation and water permeation.

If, therefore, this three-dimensionally constructed net is embedded to serve as a water collection and discharge net, a protection net in the faces of slopes or the like in residential sites or created land, the hollow interior of said cord portions serves as a flow passage to ensure efficient ventilating and water collecting and discharging functions.

Furthermore, the fill-up earth on the net contacts the lower earth layer at the voids to allow the gravity of said fill-up earth to pass to the lower earth layer, whereby the load on the cord portions can be decreased to allow the cord portions to be maintained in their three-dimensional form, which does not impair the ventilating and water collecting and discharging functions.

Further, since the cord portions are of hollow three-dimensional construction, the net is light in weight and easy to handle, so that transportation, storage and installation operations, including embedding and taut spreading, can be easily effected.

Therefore, the three-dimensionally constructed net of the present invention can be suitably utilized as a water collection and discharge net or water absorption net in the face of a slope in created land or as a slope face stabilizing and protecting net; the possession of voids by said cord portions develops good ventilating and water collecting and discharging effects, thus effectively performing protection and stabilization of slope faces.

Further, since the cord portions are of hollow three-dimensional construction and have a large surface area, the net can be also suitably used as a spray sowing net or a plant growth protecting net and so forth. Further, the three-dimensional construction of the net may be utilized to use the net as a building net, a structure making net, an agricultural net or a light-shielding net and so forth, and by changing the mesh size, the thickness of the cord portions or the like, the amount of ventilation of light can be optionally set; therefore, the net can be suitably utilized for wind protection, light-shielding and glare protection and so forth.

Further, the three-dimensionally constructed net which is formed by knitting or weaving means of the present invention may be suitably utilized by being embedded in a secondary product of concrete or the like for ventilation and water passage for weight saving.

The aforesaid three-dimensionally constructed net may comprise front and back fabrics forming a net structure and connecting yarn for connecting said front and back fabrics to form the net, wherein the cord portions defining the meshes are made in hollow three-dimensional construction capable of ventilation and water permeation by the front and back fabrics and connecting yarns (claim 2).

This arrangement allows easy production of said three-dimensionally constructed net exhibiting said effects. Particularly a knitted or woven net is superior in unitness, with its cord portions having improved ventilative and water-permeable properties.

Further, said cord portions may each have inserted therein a ventilative and water-permeable pipe body, such as a perforated pipe of synthetic resin or a meshy pipe of fiber and so forth, or a cord-like element (claim 3).

In this case, the characteristic properties of the three-dimensionally constructed net can be further improved. Particularly, suitable selection of a pipe body or a cord-like element to be inserted in the cord portions enables the net to be widely used, e.g., as a medical net, besides the various nets mentioned above.

In the case where a ventilative and water-permeable pipe body, such as a perforated or meshy pipe or the like, is inserted, said pipe body improves the retention force and strength of the cord portions and is superior in pressure resistance, satisfactorily maintaining the voids in the hollow portion, and further satisfactorily retaining the ventilative and water discharging properties. Also, insertion of a cord-like element, such as a rope, improves the shape retention of the hollow three-dimensional cord portions and also improves other properties such as the strength and so forth while securing ventilating and water collecting and discharging functions.

Further, when the three-dimensionally constructed net of the present invention is formed by knitting or weaving means, one of the front and back fabrics is made in net construction while the other is made in plain construction, said front and back fabrics being connected by a connecting yarn, so that the cord portions defining the meshes on one side can be formed in hollow three-dimensional construction capable of ventilation and water permeation (claim 4).

In this case, the net combines the function of a sheet provided by said plain fabric and the function of the three-dimensionally constructed net on one side, wherein the net shape can be satisfactorily retained and the hollow three-dimensional construction of the cord portions of the net ensures the same good ventilating and water collecting and discharging functions as described above.

Further, the three-dimensionally constructed net according to the invention is in the form of a double fabric which is knitted or woven and which comprises a double fabric portion forming a hollow portion continuous in one direction and a net portion, in which net portion the cord portions defining the meshes are made in hollow three-dimensional construction capable of ventilation and water permeation, while long-sized linear bodies, such as pipes, perforated pipes, ropes or the like, are inserted in the hollow portions of the double fabric portion (claim 5).

According to this net, the pipe or perforated pipe makes it possible to retain superior water feeding or discharging property in addition to ventilative and water-permeable properties provided by the net portion of the hollow three-dimensional construction. Further, the insertion of a rope in said hollow portion increases the strength of the net.

Further, a number of meshy pipes of fiber or synthetic resin may be crosswise joined together to form a net, wherein the cord portions which define the meshes are made in hollow three-dimensional construction capable of ventilation and water permeation by utilizing the meshy pipes (claim 6).

In the case of this net, the hollow three-dimensional construction ensures the same good ventilating and water collecting and discharging functions as described above and makes the net high in shape retention strength and in durability.

Further, a perforated pipe of synthetic resin or meshy pipe of fiber may be inserted in a non-woven fabric, said non-woven fabric being cut at required places to define meshes, thereby providing a three-dimensionally constructed net (claim 7).

With this net, coupled with the fact that the non-woven fabric itself has ventilative and water-permeable properties, the hollow three-dimensional construction of the cord portions ensures good ventilating and water collecting and discharging functions.

PREFERRED EMBODIMENTS OF THE INVENTION

Embodiments of the invention will now be described with reference to the drawings.

Figure 1:
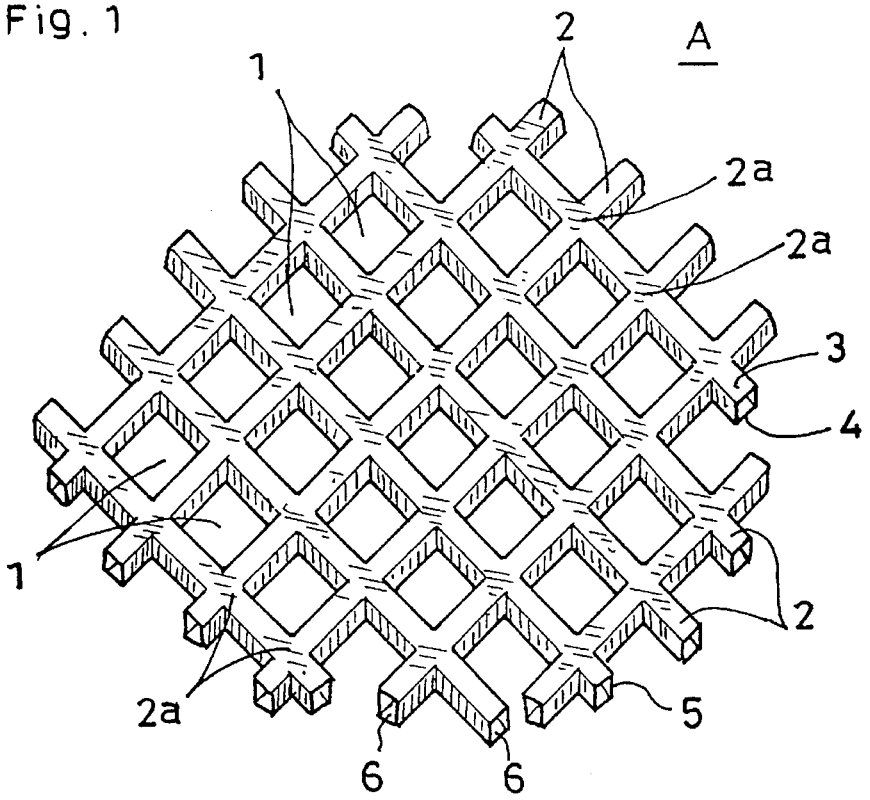
FIG. 1 is a schematic perspective view showing a first embodiment of the present invention.
Figure 2:
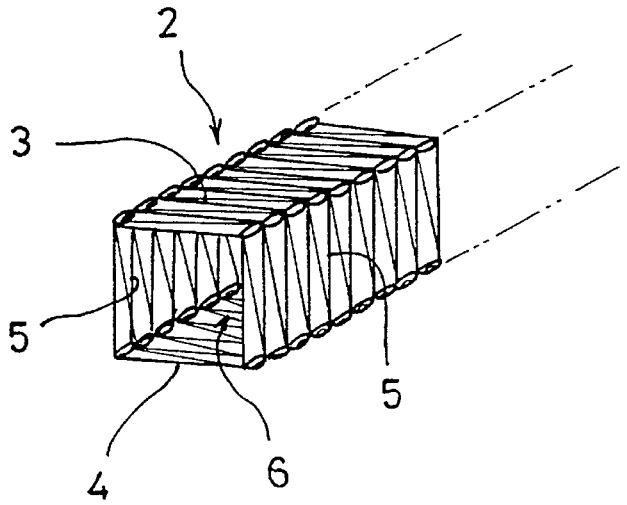
FIG. 2 is an enlarged perspective view of a portion of the same.

FIG. 1 shows the external appearance of a three-dimensionally constructed net A based on warp-knit structure, and FIG. 2 shows a portion thereof in enlargement. In these figures, the numeral 1 denotes meshes, and 2 denotes cord portions defining said meshes 1, said cord portion 2 forming a hollow three-dimensional structure capable of ventilation and water permeation in the longitudinal direction and also between inside and outside. The character 2*a* denotes knots between adjacent cord portions 2.

Figure 3:
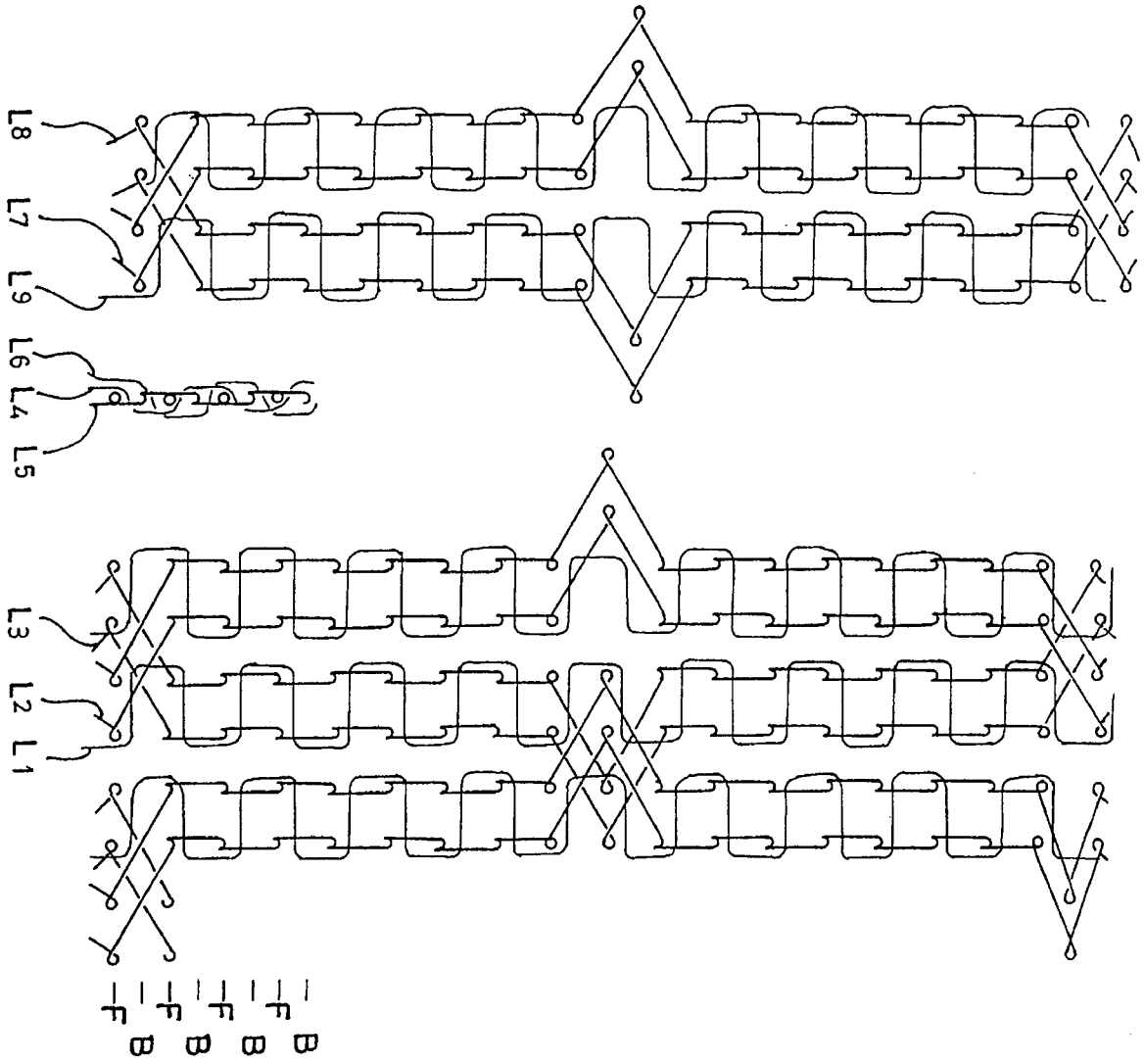
FIG. 3 is an explanatory view showing lapping form based on a concrete knitted structure.

The net A in this embodiment is knitted by a double Raschel machine and basically it comprises front and back fabrics 3 and 4 of relatively coarse mesh net structure, and connecting yarns 5 connecting said front and back fabrics 3 and 4. Particularly, the connecting yarns 5 are extended between the front and back fabrics 3 and 4 at two adjoining wales and knitted thereinto, and the cord portions 2 are made in hollow three-dimensional construction by the front and back fabrics 3 and 4 and connecting yarns 5 at two adjoining wales. FIG. 3 shows an example of such knitted structure.

Figure 4:
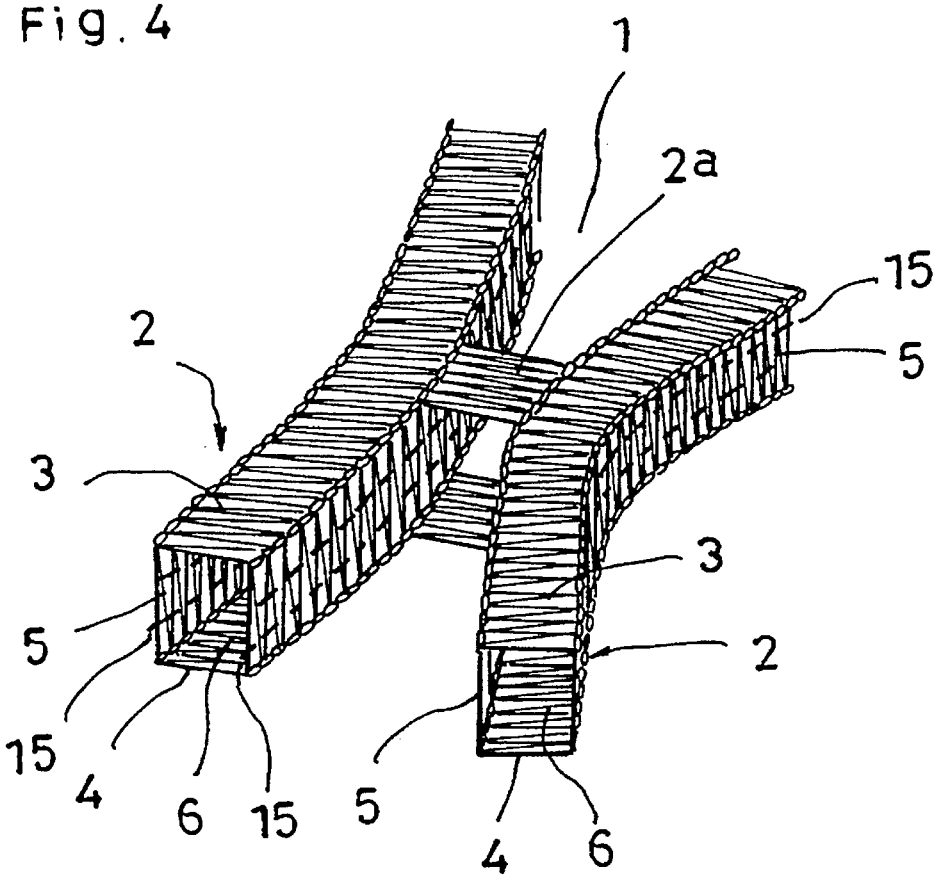
FIG. 4 is an enlarged perspective view of a portion of a net based on said structure.

In the example of knitted structure shown in FIG. 3, the front fabric 3 of the net structure is knitted by chain stitch guide bars L2 and L3 and a yarn insertion guide bar L1 on the front side by traversing said chain stitch guide bars for each required course, while the back fabric 4 of the net structure is likewise knitted by chain stitch guide bars L7 and L8 and a yarn insertion guide bar L9 on the back side by traversing said chain stitch guide bars for each required course. And the connecting yarns 5 are extended between the front and back fabrics 3 and 4 by a full-set guide bar L5 and knitted so as to connect the front and back fabrics 3 and 4 and form hollow three-dimensional body which is a single cord portion 2. After this knitting operation, said knitted fabrics are heat-set after they are expanded to a suitable width in net form, thereby providing a net A having the cord portions 2 made in hollow three-dimensional construction. FIG. 4 shows a portion of the net A of knitted structure of FIG. 3. The numeral 6 denotes the hollow space of the cord portion 2.

In addition, L4 and L6 in FIG. 3 denote guide bars for warp insertion, serving to insert warp yarns 15 without forming stitches, as shown in FIG. 4, when the loops in the bridge portion of the connecting yarn 6 between the front and back fabrics 3 and 4 are coarse; said guide bars are not absolutely necessary. Further, the connecting yarn 5 associated with the guide bar L5 may be lapped by two guide bars depending upon the lapping direction or the like in the cord portions 2 for defining the meshes 1.

The size of the meshes 1 in said net A based on double Raschel knitting can be adjusted by increasing or decreasing the number of courses in the knots 2*a* between adjacent cord portions 2. The shape of the mesh openings may be optionally determined by the knitting structure; for example, the openings may be hexagonal, quadrangular or the like. Further, they may be oblique or quadrangular lattice-shaped throughout the net. Further, the size of the cross section of the cord portions 2 may be suitably determined by adjusting the distance between the front and back fabrics 3 and 4 and/or the wale distance in the front and back fabrics 3 and 4.

Figure 5:
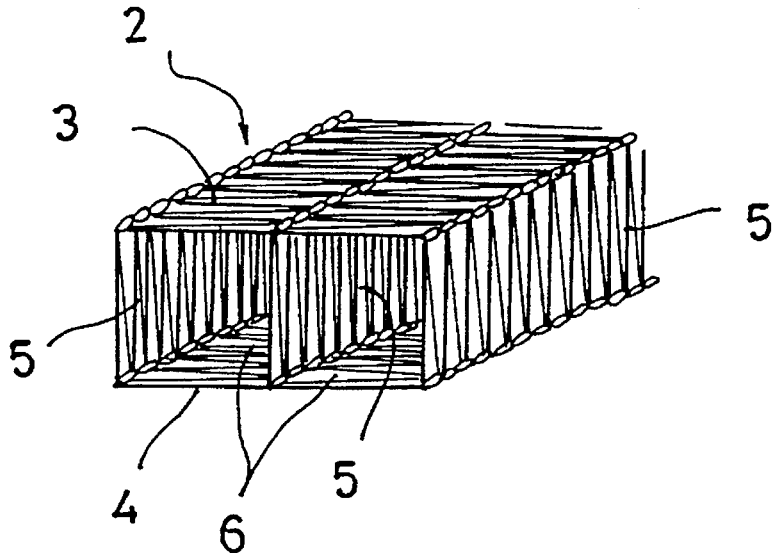
FIG. 5 is an enlarged perspective view of a portion showing another embodiment.

Further, as shown in FIG. 5, the cord portions 2 may be knitted to have a width of 3 or more wales (usually, several to tens of wales) and to connect the front and back fabrics 3 and 4 by the connecting yarn 5 in each wale, so as to divide the inner hollow space 6 into a plurality of parts. Further, if the width extends three or more wales, the connecting yarn for intermediate wales may be omitted to connect the front and back fabrics 3 and 4 by the connecting yarn 5 at least in the opposite end wales, so as to define a large hollow space in the interior.

In the above net A, though in a non-limiting sense, for the threads forming the front and back fabrics 3 and 4, use is made usually of synthetic fiber threads which are superior in water resistance; nylon yarns, carbon fiber yarns and other various synthetic fiber multifilament and monofilament yarns are used with good results. The thickness and material of the yarns are determined in consideration of the required strength, tension, elasticity and the like. For the connecting yarns 5 suitable for connecting said front and back fabrics 3 and 4 and supporting three-dimensional construction, selections are suitably made from synthetic fiber threads in consideration of elasticity, strength and the like, as in the above case, and mostly, monofilament yarns are used with good results. Heat setting or synthetic resin treatment may be applied to these threads after knitting, so as to impart suitable degrees of rigidity and compression resistance. The greater the number of connecting yarns 5 for connecting the front and back fabrics 3 and 4, the greater the compression resisting strength.

Further, if elastic yarns are used for all or part of the yarns forming the front and back fabrics 3 and 4 and connecting yarns 5, it is possible to provide a net of hollow three-dimensional construction having stretchability. In this case, there is obtained fitness of the kind which cannot be found in a net which does not use elastic yarns.

Figure 6A:
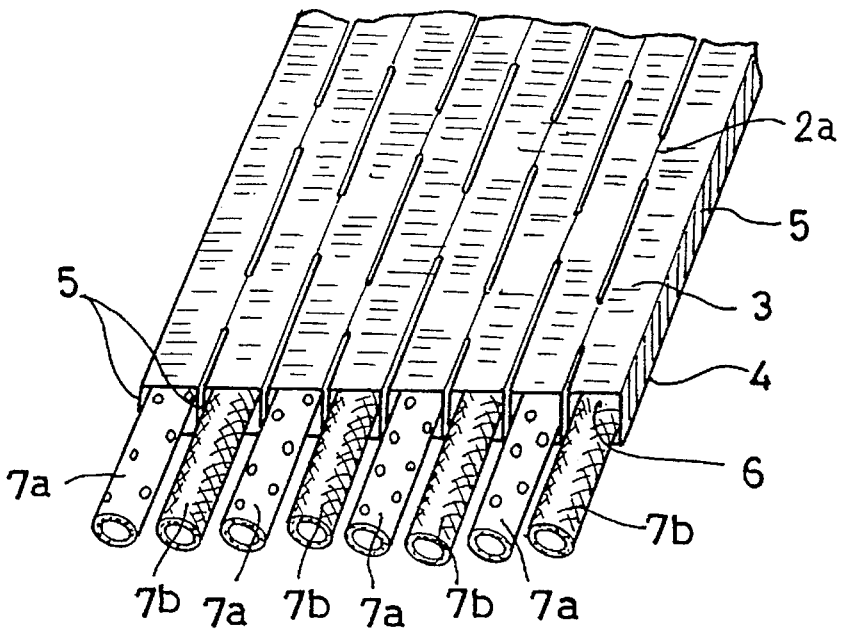
FIG. 6 is a schematic perspective view of a knitted state (a) and a net state (b), showing another embodiment wherein a pipe body is inserted in each cord portion.
Figure 6B:
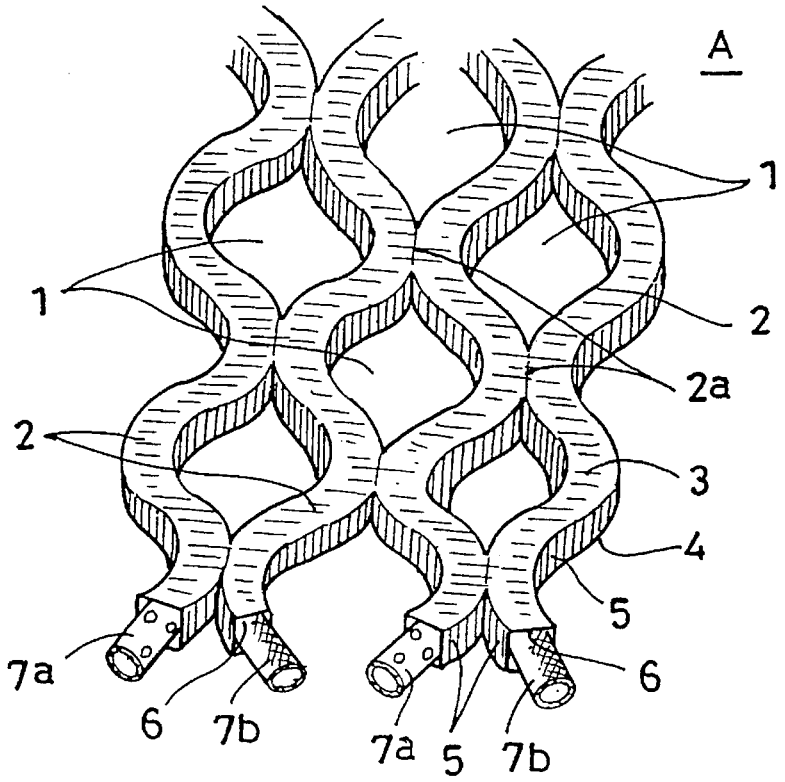

Further, in the three-dimensionally constructed net A of net structure provided by double Raschel Knitting, the knitted structure resulting from warp insertion may be utilized to insert a ventilative and water-permeable pipe body, such as a perforated pipe 7*a* of synthetic resin or meshy pipe 7*b* of fiber or the like, into the cord portions 2 defining the meshes 1, as shown in FIG. 6. This may be knitted, for example, in the structure shown in FIG. 3, by inserting said meshy pipes 7*a* and 7*b* between two adjacent wales in the cord portions 2. FIG. 6(*a*) shows the knitted state and (*b*) in the same figure shows a net made by widthwise expanding the knitted fabric. Said pipe bodies may be inserted by post-insertion.

The perforated pipe 7*a* is a pipe of synthetic resin, such as polyvinyl chloride, polyethylene or nylon, having a large number of small holes formed in the entire surface thereof or the like pipe. Further, the meshy pipe 7*b* is a pipe formed by knitting or braiding a synthetic resin material, such as synthetic fiber threads or the like, in mesh form, or is a meshy pipe of metallic fiber. Each of them has suitable degrees of flexibility and elasticity and has a pressure-resisting and shape-retaining strength.

Therefore, in the case of this embodiment, the pressure-resisting strength of the cord portion 2 having the pipe 7*a* or 7*b* inserted therein is greater than in the case of the preceding embodiment and reliably retains the three-dimensional construction.

The three-dimensionally constructed net A having the perforated pipes 7*a* or meshy pipes 7*b* inserted therein described above can be formed by knitting, though not shown, while inserting said pipes by warp insertion or weft insertion in a net structure provided by Raschel knitting and superposing and sewing two such fabrics together, with said pipes crossing each other in lattice form, the pipe portions forming cord portions, the spaces defined by two crossing pipe portions being opened as meshes. Further, in the same Raschel knitting as described above, a net may be formed by warp knitting such that the pipes cross each other by warp and weft insertion, the pipe portions forming cord portions, the spaces defined therebetween being opened as meshes.

Further, besides said pipe bodies, other cord-like elements may be inserted into the three-dimensionally constructed cord portions 2 of the net A depending upon application and purpose.

Figure 7:
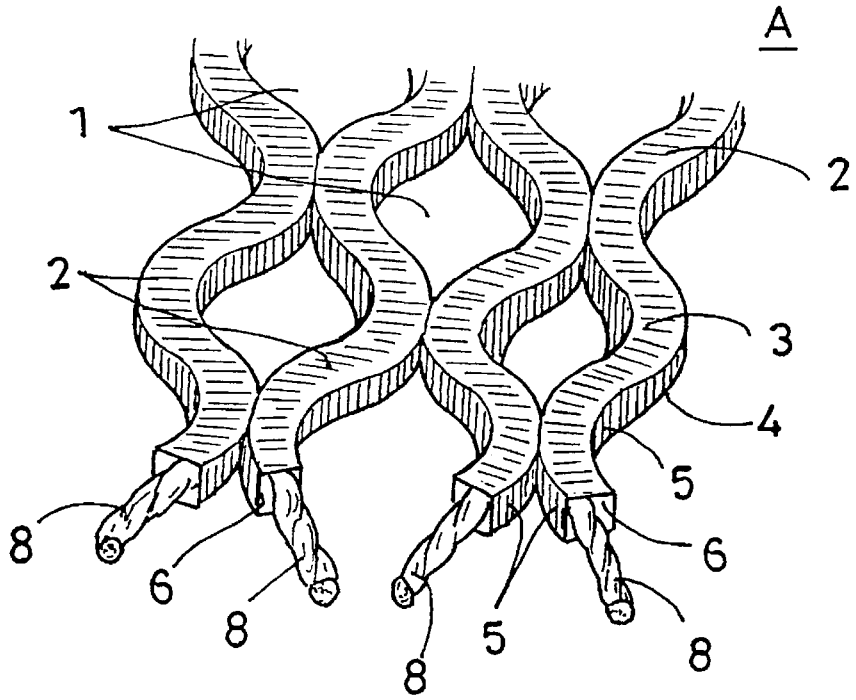
FIG. 7 is a schematic perspective view showing an embodiment wherein a cord-like element is inserted in each cord portion.

For example, as shown in FIG. 7, a reinforcing cord 8, such as a rope or yarn, can be inserted. In this case, the hollow three-dimensional construction of the cord portions 2 can be satisfactorily retained by the cords 8 and presence of vacant space around the cords 8 retains good ventilating and water collecting and discharging functions and increases the strength of the net to resist pulling or the like, thus facilitating installation and handling during taut spreading.

Further, a water-absorbable elastic cord-like element made of cotton, non-woven fabric or sponge may be inserted in the cord portions 2. In this case, since the cord-like elements themselves have ventilative and water- permeable properties, good ventilating and water collecting and discharging functions can be retained even if they are filled in the cord portions 2. Further, a cushioning property can be imparted to the cord portions 2 and to the entire net. In addition, stretchability may be imparted by inserting a stretchable cord-like element, such as an elastic yarn.

A cord-like element holding seeds, fertilizer, medicinal chemicals or the like may be inserted in the cord portion 2. In this case, the net may have a special function corresponding to its use, e.g., a plant glowing net or medical net.

In addition, in cord portions 2 having a width corresponding to three or more wales as shown in FIG. 5, and in the case where a large hollow space is defined in the interior by omitting the connecting yarns particularly for the intermediate wales, a pipe body or cord-like element having a large diameter can be inserted.

Further, in the aforesaid three-dimensionally constructed net A, the invention can also be embodied by partly omitting the connecting yarns 5 for connecting the front and back fabrics 3 and 4, opening part of the lateral surfaces of the cord portions 2 and inserting said pipe bodies in the direction which crosses the cord portions 2.

Figure 8:
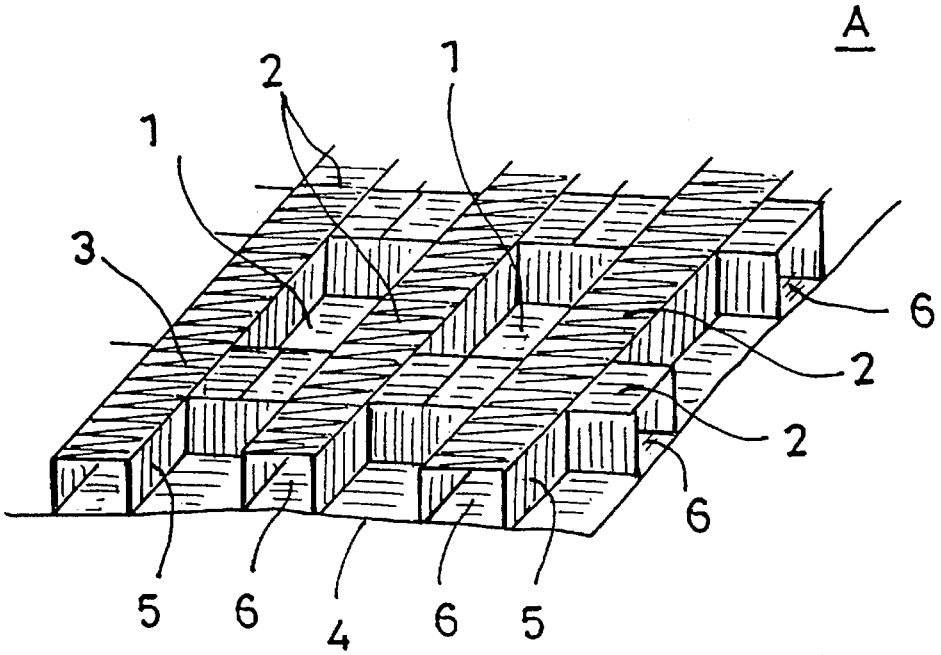
FIG. 8 is a schematic perspective view showing still another embodiment.

FIG. 8 shows another embodiment of a three-dimensionally constructed net A of the present invention. In the net A of this embodiment, one of the front and back fabrics, e.g., the front fabric 3 is made in net construction by knitting, weaving or other means, e.g., warp knitting, while the other fabric 4 is made in plain construction, said front and back fabrics 3 and 4 being connected by connecting yarns 5, so that the cord portions 2 defining the meshes 1 on one side are constructed in hollow three-dimensional form capable of ventilation and water permeation.

In the case of this net A, two functions are obtained: the function of a sheet provided by the fabric 4 of plain construction and the function of a net provided by the three-dimensional construction in one side, the net shape being satisfactorily retained and because of the hollow three-dimensional construction of the cord portions, the same good ventilating and water collecting and discharging functions as described above can be retained.

In this embodiment also, the size of the meshes 1, the thickness and so on can be optionally determined depending upon applications, and as to the type of the constituent yarns to be used, elastic yarns, non-elastic yarns, cotton yarns or other yarns may be selectively used to give variations in the size or shape of the meshes 1 or the like.

Figure 9A:
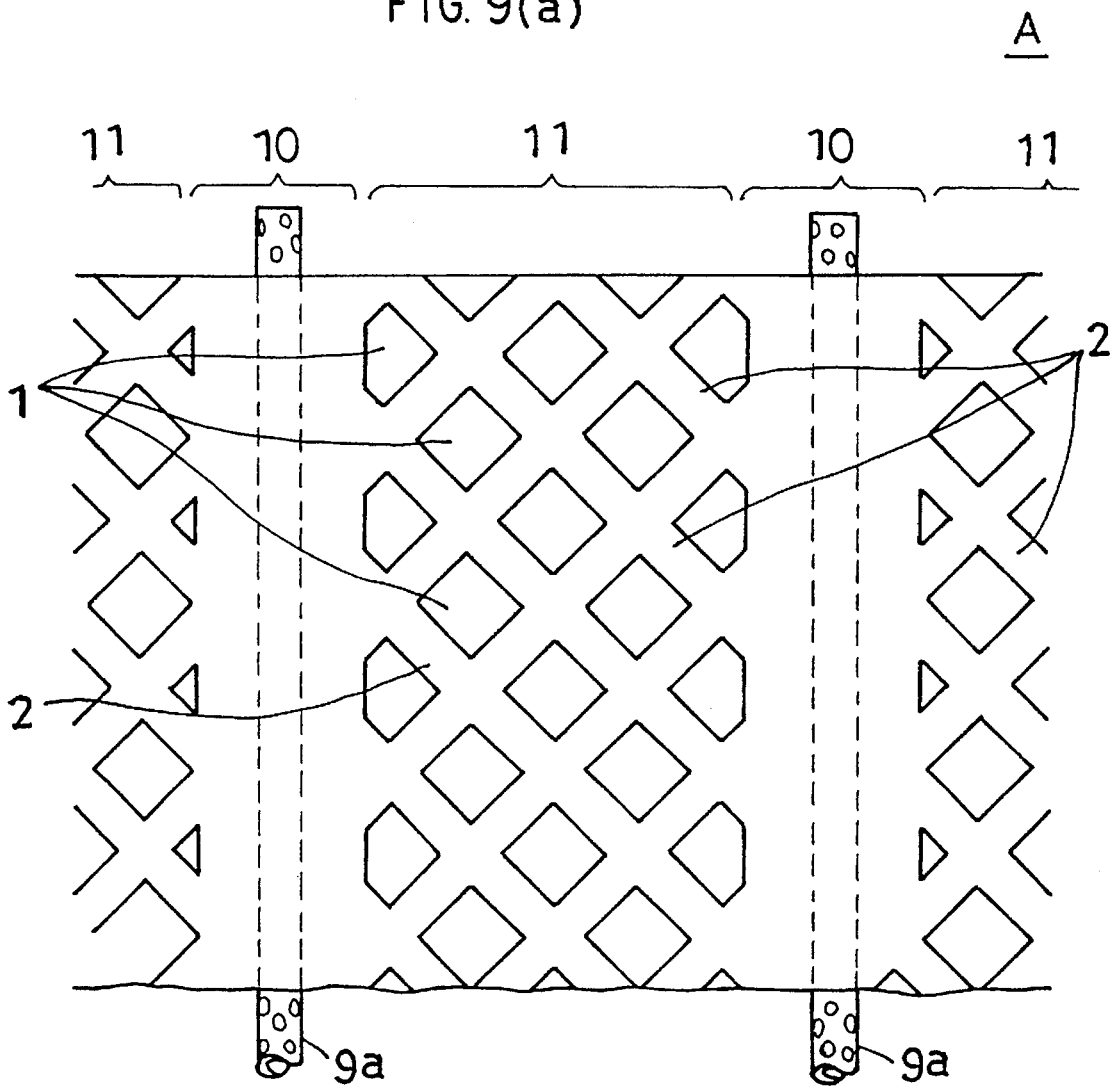
FIG. 9 is a schematic plan view (a) and a sectional view (b), showing another embodiment based on a double fabric.
Figure 9B:
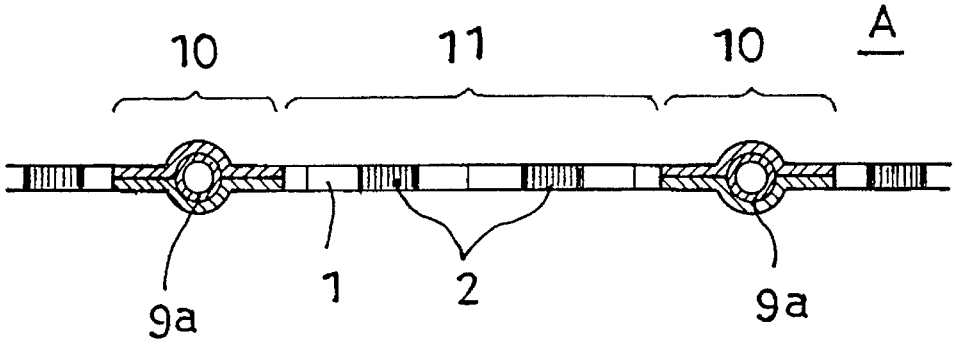
Figure 10A:
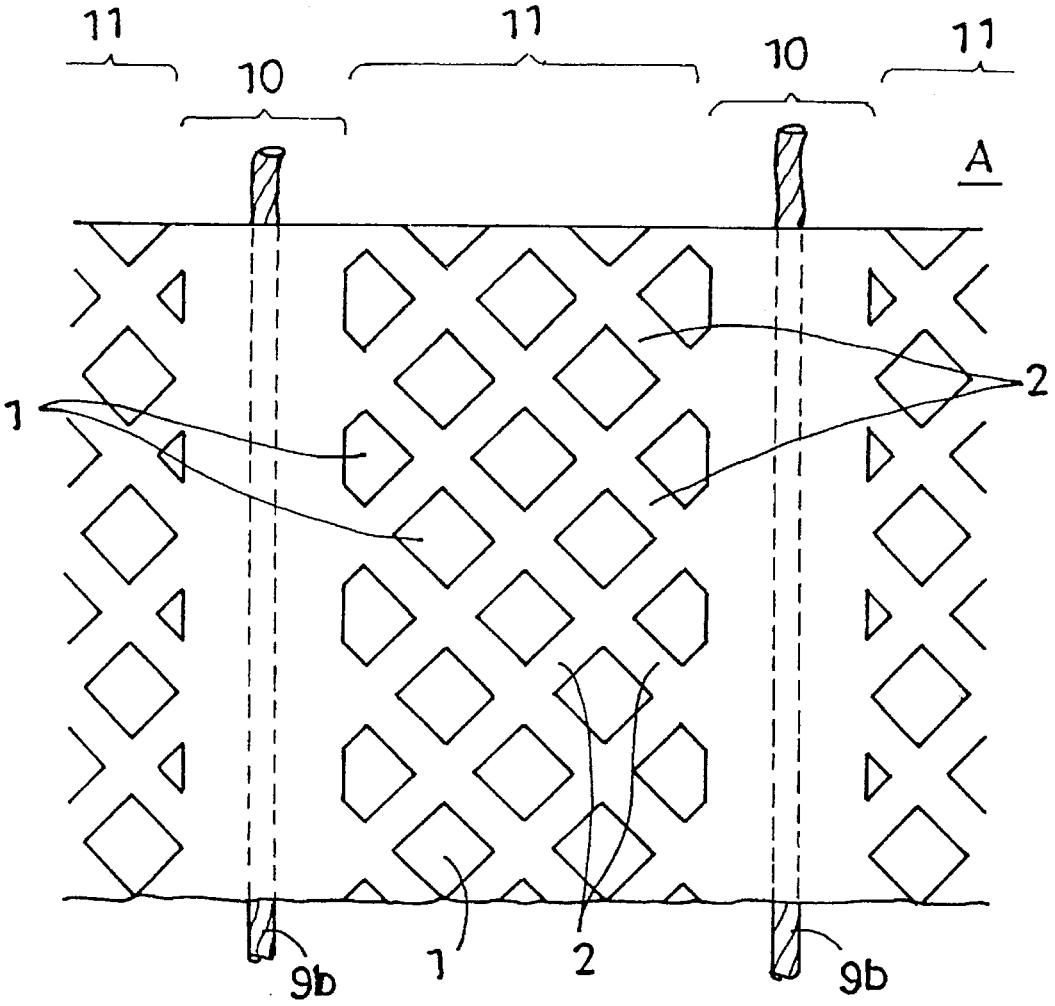
FIG. 10 is a schematic plan view (a) and a sectional view (b), showing still another embodiment.
Figure 10B:
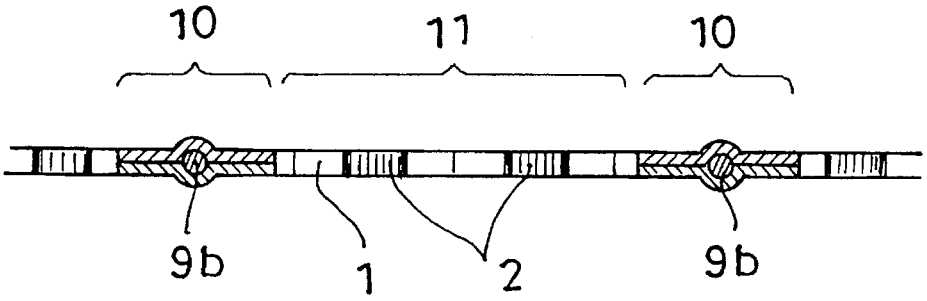

FIGS. 9 and 10 show still another embodiment of a three-dimensionally constructed net A according to the present invention. The net A of this embodiment is in the form of a double fabric which is knitted or woven comprises double fabric portions 10 and net portions 11, the former being knitted or woven and forming hollow portions continuous in one direction, wherein the cord portions 2 defining the mesh openings 1 in the net portions 11 are constructed in hollow three-dimensional form capable of ventilation and water permeation.

In this case, long-sized linear bodies, such as pipes or perforated pipes 9*a*, ropes 9*b*, cords or the like, may be inserted in the hollow portions of the double fabric portions 10.

For example, in the case where perforated pipes 9*a* are inserted, as shown in FIG. 9, the net has a superior water feeding or water collecting and discharging function provided by the perforated pipes 9*a* in the double fabric portions 10 in addition to the ventilative and water-permeable properties of the hollow three-dimensionally constructed net portions 11. Further, as shown in FIG. 10, insertion of ropes 9*b* increases the strength of the net A, thus facilitating operations such as installing and taut spreading.

Figure 11:
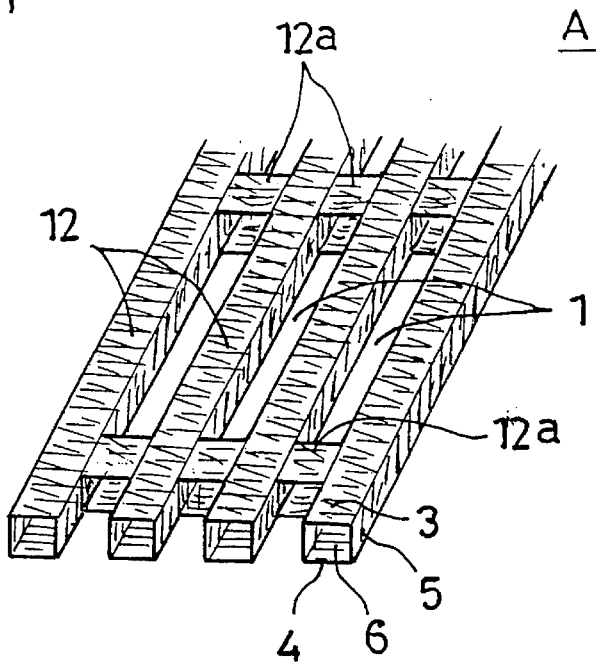
FIG. 11 is a schematic perspective view showing an embodiment providing a screen-like net.

The three-dimensionally constructed net A of the present invention, as shown in FIG. 11, can be formed by parallelly arranging a number of warpwise continuous cord portions 12 in hollow three-dimensional form and connecting them by weftwise extending cord-like portions 12*a* to form a lattice-like net, with the warpwise extending cord portions 12 resembling a reed screen.

Such screen-like net A can also be produced with ease by warp knitting. For example, it can be obtained by knitting at intervals of two or more needles the portions corresponding to the warpwise extending cord portions 12 connecting the front and back fabrics 3 and 4 by the connecting yarns 5, and connecting the cord portions 12 at places corresponding to the weftwise extending cord portions 12*a* for each course.

This screen-like net A is easily bendable, light in weight and easy to install. Further, since the cord portions 2 are continuous in the warp direction, the use of the net as a water discharging net allows the user to expect a uniform and good water discharge effect over a wide range In addition, in each of the embodiments shown in FIGS. 8 through 11, pipe bodies or core-like elements can be inserted in the cord portions 2 and 12, as in the case of FIGS. 6 and 7.

Further, not being limited to said warp knitting using the double Raschel machine, the net may be formed by knitting means such as weft knitting, circular knitting and braiding or weaving means, wherein as in the above, a three-dimensionally constructed net is formed of the front and back fabrics and connecting yarns for connecting said front and back fabrics and the cord portions defining the meshes are made in hollow three-dimensional construction.

Though not shown, instead of initially constructing a net form by said means, a three-dimensional form may be first constructed and then knife-cut or heat-cut at required places and widthwise expanded, thereby forming a net. Further, a net may also be produced by using similar means and a non-woven fabric as a base material, such that perforated pipes or meshy pipes are inserted in said non-woven fabric, the latter being cut at required places to define meshes.

Figure 12:
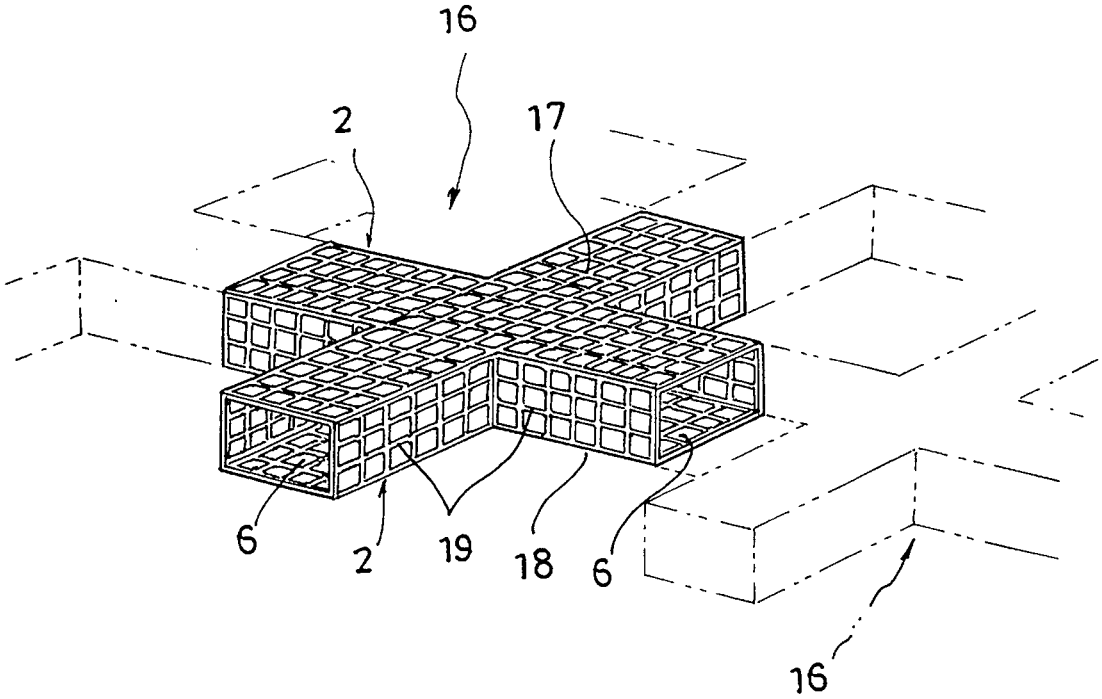
FIG. 12 is a schematic perspective view a portion, showing still another embodiment.

Further, said three-dimensionally constructed net may be formed by synthetic resin molding. An example is shown in FIG. 12, wherein an X-form net structure 16 with hollow three-dimensional cord portions 2 crossing each other is integrally molded by synthetic resin molding and a number of such net structures are connected together as indicated in phantom lines by FIG. 12, thereby forming a three-dimensionally constructed net. Preferably, the front and back surfaces 17 and 18 and lateral surfaces 19 are formed meshy or porous as shown, so that ventilation and water permeation are attained not only in the longitudinal direction but also internally and externally. In the case of this embodiment also, pipe bodies such as perforated pipes or meshy pipes, or cord-like elements such as ropes or sponges, may be inserted in the cord portions 2.

Figure 13:
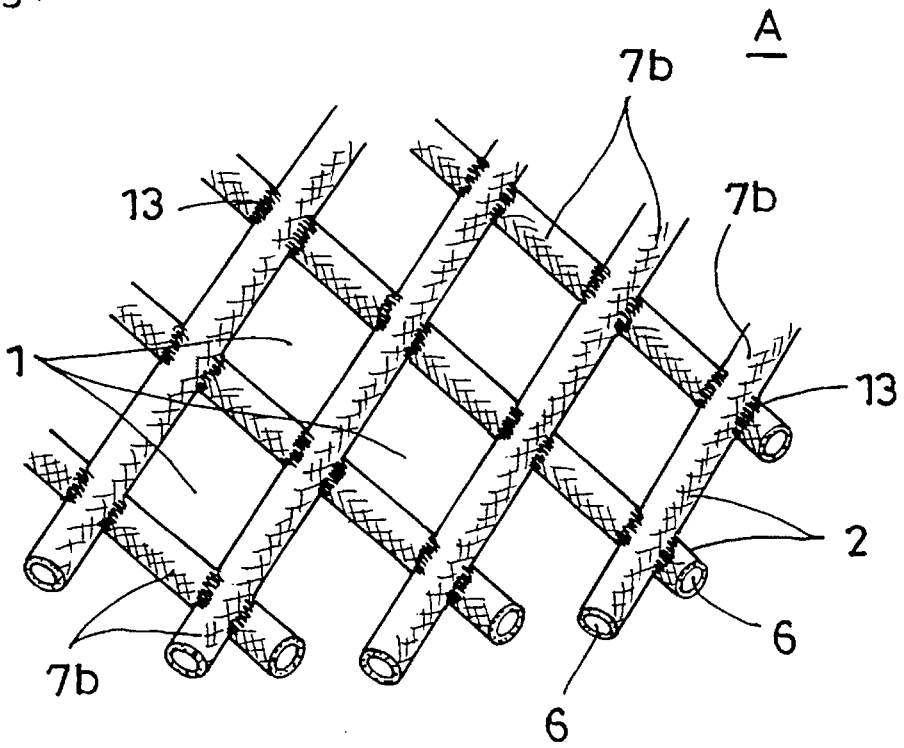
FIG. 13 is a schematic perspective view a portion, showing still another embodiment.

FIG. 13 shows an arrangement in which a number of meshy pipes 7*b* knitted of synthetic fiber or metallic fiber are disposed at required intervals in parallel crossing relation and joined together at the crossing points by sewing means or bonding or welding means, thereby forming a net. The numeral 13 denotes joined portions. In this case also, the cord portions 2 defining the meshes constitute a hollow three-dimensional structure using said meshy pipes 7*b*.

Figure 14:
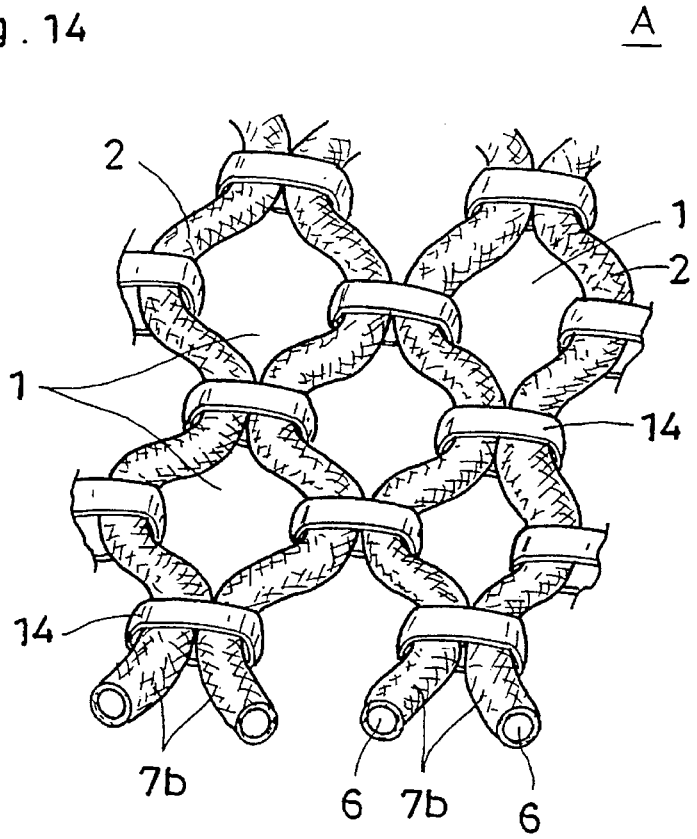
FIG. 14 is a schematic perspective view a portion, showing still another embodiment.

Further, as shown in FIG. 14, a three-dimensionally constructed net may be formed by disposing meshy pipes 7*b* similar to those mentioned above at required intervals and joining them at required places by sewing means or other joining means. The numeral 14 denotes joining members.

The thickness of the three-dimensionally constructed net A of the present invention and size of the meshes 1 and cord portions 2 differ according to uses. For example, in the case where the present net is used for civil engineering, building, agricultural, marine or the like purposes, considerably large nets can be used and usually the net thickness is 2 to some 100 mm, the diameter of the meshes is 2 to 6000 mm, the width of the cord portions 2 is 2 to 2000 mm. In general, they are used in the mesh diameter range of 2 to 1000 mm and the cord portion width range of 2 to 500 mm. For sports, garments and medical applications, nets having smaller dimensions than those mentioned above are sometimes demanded.

The three-dimensionally constructed net A described above is used as a water collecting and discharging net, a water absorbing net, a stabilizing net or a protecting net in the faces of slopes in residential sites or created land, or a spray sowing net, a plant protecting net, building protecting net, a structure making net, a medical net or the like.

Since this net A has its cord portions 2, 12 defining the meshes 1 three-dimensionally constructed, it is light in weight and easy to handle despite the three-dimensional construction having the required thickness, and it well conforms to the ridges and troughs of slope faces, so that installing operations, such as embedding or taut spreading, can be easily performed. Further, if said net is used for planting, it prevents outflow of seeds and earth brought from another place and mixed in the soil and makes it possible effect spray sowing uniformly and satisfactorily.

Figure 15:
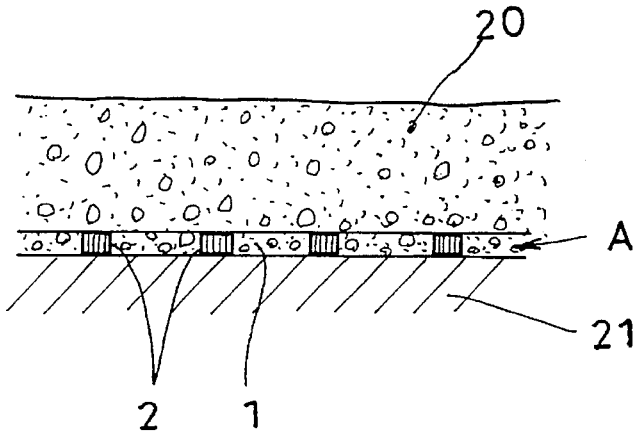
FIG. 15 is a sectional view, wherein a net is used as a water collection and discharge net for created land and so forth.

And when this net A is embedded as a water collecting and discharging net in the faces of slopes in created land, as shown in FIG. 15, fill-up earth 20 on the net A contacts an underlying earth layer 21 through voids provided by the meshes 1, enabling the gravity of said fill-up earth 20 to pass to the underlying earth layer 21, thereby reducing the load on the cord portions 2, 12 and satisfactorily retaining the three-dimensional construction of said cord portions 2, 12.

Furthermore, the hollow three-dimensional construction of the cord portions 2, 12 provides an increased surface area and the hollow construction provides a high void content as compared with that provided by the common three-dimensional construction, said hollow 6 serving as a flow passage for efficient ventilation and water collection and discharge. Particularly, in the case where perforated pipes 7*a* or meshy pipes 7*b* are inserted in the cord portions 2, as shown in FIG. 6, the ventilating and water collecting and discharging properties are further improved.

Further, in the conventional method in which common water discharge pipes are embedded radially or in a stripe pattern, the water collecting and discharging effect becomes nonuniform; however, if the three-dimensionally constructed net of the present invention is used, the net form makes it possible to expect a uniform water collecting and discharging effect.

What is claimed is:

1. A three-dimensionally constructed net comprising:

cord portions which define mesh openings in said net, wherein said cord portions are in the form of a hollow three-dimensional construction capable of ventilation and water permeation, and wherein said cord portions have inserted therein a plurality of ventilative and water-permeable pipe bodies which are crosswise joined together.

2. A three-dimensionally constructed net comprising:

cord portions which define mesh openings in said net, wherein said cord portions are in the form of a hollow three-dimensional construction capable of ventilation and water permeation; and water permeable pipe bodies received within a non-woven fabric;

said non-woven fabric having cutouts therein, said non-woven fabric and said cutouts corresponding to said cord portions and said mesh openings respectively.

3. A three-dimensionally constructed net as set forth in claim 1, wherein said plurality of ventilative and water-permeable pipe bodies include pipes composed of meshy fiber or perforated synthetic resin.

4. A three-dimensionally constructed net as set forth in claim 2, wherein said water permeable pipe bodies include perforated pipes of synthetic resin or meshy pipes of fiber.

5. A three-dimensionally constructed net comprising hollow three-dimensional cords reticulated to form a net having mesh openings, each of said cords comprising first and second fabrics and connecting yarns for connecting and displacing apart said first and second fabrics in three dimensions, a plurality of rows of said connecting yarns spanning between said two fabrics to form a continuous hollow interior in each of said cords, each of said hollow interiors being bounded on first opposing sides by said first and second fabrics and on second opposing sides by said connecting yarns, each of said hollow three-dimensional cords being capable of ventilation and water permeation.

6. A three-dimensional net comprising:

a first fabric having rows of stitches arranged in a net pattern having mesh openings, the first fabric forming a front surface of said three dimensional net;

a second fabric having a plain construction, the second fabric being in alignment with said first fabric to form a back surface of said three dimensional net; and connecting yarns interconnecting and displacing apart said rows of stitches of said first fabric and said second fabric to form cord structures having a continuous hollow interior capable of ventilation and water permeation, each of said hollow interiors being bounded on first opposing sides by said first and second fabrics and on second opposing sides by said connecting yarns.

7. A three-dimensionally constructed net comprising a double fabric portion and a net portion adjacent to each other, said double fabric portion forming a hollow portion for receiving linear bodies, and said net portion comprising hollow three-dimensional cords reticulated to form a net having mesh openings, each of said cords comprising two fabrics, front and back, of net construction, each fabric comprising a plurality of rows of stitches arranged in a net pattern, connecting yarns for interconnecting and displacing apart said rows of stitches of said first fabric and said second fabric to form cord structures having a continuous hollow interior capable of ventilation and water permeation, each of said hollow interiors being bounded on first opposing sides by said first and second fabrics and on second opposing sides by said connecting yarns.

8. A three-dimensionally constructed net as set forth in any one of claims 5 to 7, wherein each group of stitches comprises a plurality of chain stitches, and insert yarns inserted therein.

9. A three-dimensionally constructed net as set forth in claim 8, wherein:

at least a portion of said cords have inserted therein a ventilative and water-permeable pipe body.

10. A three-dimensionally constructed net as set forth in claim 5, wherein:

said cords are arranged in rows, each of said cord portions being attached to adjacent ones to permit widthwise expansion of said net by a lateral widening of said mesh openings caused by a deformation of said cords.

11. A three-dimensionally constructed net as set forth in claim 1, wherein:

said cords each have inserted therein a ventilative and water-permeable pipe body.

12. A three-dimensionally constructed net as set forth in claim 5, wherein:

said net is formed by knitting or weaving means such that one of the front and back fabrics is made in net construction while the other is made in plain construction; and said front and back fabrics are connected by connecting yarns, so that said cords defining said mesh openings are disposed on a one side of said net.

13. A three-dimensionally constructed net as set forth in claim 11, further comprising a ventilative and water-permeable pipe body including a perforated pipe of synthetic resin, a meshy pipe of fiber, or a cord-like element inserted in each of said cords.

14. A three-dimensionally constructed net as set forth in claim 7, wherein said linear bodies include pipes, perforated pipes or ropes.

* * * * *